United States Patent [19]

Gerry

[11] 4,122,815

[45] Oct. 31, 1978

[54] NON-DC IGNITION SYSTEM WITH VARIABLE IGNITION TIMING

[76] Inventor: Martin E. Gerry, 13452 Winthrope St., Santa Ana, Calif. 92705

[21] Appl. No.: 783,388

[22] Filed: Mar. 31, 1977

[51] Int. Cl.[2] ..... F02P 3/02

[52] U.S. Cl. ..... 123/148 E; 123/117 R; 123/148 B; 123/148 CC

[58] Field of Search ..... 123/117 R, 148 E, 148 B, 123/148 CC

[56] References Cited

U.S. PATENT DOCUMENTS

| | | | |
|---|---|---|---|
| 1,093,072 | 4/1914 | Perkin | 123/148 B |
| 2,497,307 | 2/1950 | Lang | 123/148 B |
| 3,621,826 | 11/1971 | Chrestensen | 123/148 E |
| 3,820,520 | 6/1974 | Canup | 123/148 E |
| 3,861,369 | 1/1975 | Canup | 123/148 E |

*Primary Examiner*—Charles J. Myhre
*Assistant Examiner*—R. A. Nelli

[57] ABSTRACT

An ignition system providing variable ignition timing periods to an engine during operative mode of the system includes an angularly modulated waveform generator, an electronic control circuit electrically coupled to the generator, such control circuit being intermittently biased by the generator during the system's operation, and a power source which provides output power whose amplitude varies as a function of time, the power source being electrically connected to the control circuit. An integrator circuit may be interposed between the waveform generator and the electronic control circuit. The generator has a variable capacitor which is driven by the distributor shaft and therefore such generator provides angular modulated wave trains used to intermittently bias the control circuit. The power source is activated by the control circuit to provide non-DC output power to the ignition transformer so as to energize the igniters of the system with high energy alternating power.

25 Claims, 23 Drawing Figures

(1)

$$V_u(t) = L_1 \frac{di_1}{dt} + R_1 i_1 - M \frac{di_2}{dt}$$

$$0 = -M \frac{di_1}{dt} + L_2 \frac{di_2}{dt} + R_2 i_2 \qquad (2)$$

$$\frac{V}{s} = (L_1 s + R_1) I_1 - M s I_2$$

$$0 = -M s I_1 + (L_2 s + R_2) I_2 \qquad (3)$$

$$I_1 = \frac{\frac{V}{s}(L_2 s + R_2)}{(L_1 L_2 - M^2)s^2 + (L_2 R_1 + L_1 R)s + R_1 R_2} \qquad (4)$$

$$L_1 L_2 = M^2 \tag{5}$$

$$= \frac{VL_2 s + VR_2}{s[(L_2 R_1 + L_1 R_2)]s + R_1 R_2} \tag{6}$$

$$= \frac{5.394s + 6.64 \times 10^2}{s(s + 77.46)} \tag{7}$$

$$i_1 = 8.57 - 3.18e^{-77.46t} \tag{8}$$

$$\alpha_1 = L_1 i_{10}\Big|_{t=1.67\times10^{-3}} = 6.7\times10^{-3}(8.57 - 3.18e^{-77.46t}) \tag{9}$$

$$= 3.87\times10^{-2} \text{ VOLTS} \tag{10}$$

$$I_2 = \frac{MV}{(L_1 s + R_1)(L_2 s + R_2) - M^2 s^2} \tag{11}$$

$$= \frac{5.48\times10^{-2}}{s + 77.46} \tag{12}$$

FIG. 7C $$i_2 = 5.48 \times 10^{-2} e^{-77.46t} \quad (13)$$

$$\alpha_2 = L_2 i_{20}\Big|_{t=1.67\times10^{-3}} = 65 \times 5.48 \times 10^{-2} e^{-0.12935}$$

$$= 3.13 \text{ VOLTS} \quad (14)$$

$$\frac{V}{s} + \alpha_1 = (L_1 s + R_1) I_1 - M s I_2$$

$$\alpha_2 = -M s I_1 + (L_2 s + R_2) I_2 \quad (15)$$

$$I_2 = \frac{\alpha_2 (L_1 s + R_1) + MV + M\alpha_1 s}{(L_1 s + R_1)(L_2 s + R_2) - M^2 s^2} \quad (16)$$

$$= \frac{8.51 \times 10^{-2} + 4.65 \times 10^{-2} s}{s + 77.46} \quad (17)$$

$$i_2 = (8.51 \times 10^{-2} - 77.46 \times 3.22 \times 10^{-4}) e^{-77.46t} \quad (18)$$

$$= 6.02 \times 10^{-2} e^{-77.46t} \quad (19)$$

FIG. 7d $$v_2 = -L_2 \frac{di_2}{dt} \quad (20)$$

$$= (-65)(6.02 \times 10^{-2})(-77.46)e^{-77.46t} \quad (21)$$

$$= 303\, e^{-77.46t} \quad (22)$$

$$\mathcal{E} = \int_{t=0}^{t=.278 \times 10^{-3}} v_2\, i_2\, dt \quad (23)$$

$$= 303 \times 6.02 \times 10^{-2} \int_0^{.278 \times 10^{-3}} e^{-154.92t}\, dt \quad (24)$$

$$= 5.12 \times 10^{-3} \text{ WATT-SECONDS} \quad (25)$$

(26)

$$V\left[\sum_{n=0}^{\infty}(-1)^n u(t-nk)\right] = L_1\frac{di_1}{dt}+R_1 i_1+\frac{1}{C_1}\int i_1\,dt - M\frac{di_2}{dt}$$

$$0 = M\frac{di_1}{dt} + L_2\frac{di_2}{dt} + R_2 i_2 \qquad (27)$$

$$\frac{V}{s(1+e^{-ks})} = (L_1 s + R_1 + \frac{1}{C_1 s})I_1 - M s I_2$$

$$0 = -M s I_1 + (L_2 s + R_2)I_2 \qquad (28)$$

$$I_2 = \frac{MV}{(1+e^{-ks})[(L_1 s + R_1 + \frac{1}{C_1 s})(L_2 s + R_2) - M^2 s^2} \qquad (29)$$

$$= \frac{MVs}{(1+e^{-ks}[(L_2 R_1 + L_1 R_2)s^2 + (\frac{L_2}{C_1} + R_1 R_2)s + \frac{R_2}{C_1}} \qquad (30)$$

$$= \frac{7.92s}{(1+e^{-10^{-5}s})[1.446\times10^2 s^2 + 3.25\times10^7 s + 4\times10^9]} \qquad (31)$$

$$i_2 = 5.25\times10^{-3}\, e^{-2.2464\times10^5 t} \qquad (32)$$

FIG. 7g $$v_2 = -L_2 \frac{di_2}{dt} \quad (33)$$

$$= (-65)(2.246 \times 10^5)(5.25 \times 10^{-3}) e^{-2.2464 \times 10^5 t} \quad (34)$$

$$= 7.67 \times 10^4 e^{-2.2464 \times 10^5 t} \quad (35)$$

$$\alpha_2 = I_2 i_{20} = L_2 i_2 \Big|_{t=1.67 \times 10^{-3}} = 4.99 \times 10^6 e^{-375} \cong 0 \quad (36)$$

$$I_1 = \frac{V(L_2 s + R_2)}{(1 + e^{-ks})[(L_2 R_1 + L_1 R_2)s^2 + (\frac{L_2}{C_1} + R_1 R_2) + \frac{R_2}{C_1}]} \quad (37)$$

$$= \frac{12(65s + 8 \times 10^3)}{(1 + e^{-10^{-5}s})[1.446 \times 10^2 s^2 + 3.25 \times 10^7 s + 4 \times 10^9]} \quad (38)$$

$$i_1 = 2.4 \times 10^{-3} + 51.5 e^{-2.2464 \times 10^5 t} + 9.24 \times 10^{-5} e^{-1.23 \times 10^2 t} \quad (39)$$

FIG. 7h $$\alpha_1 = L_1 i_{10} = L_1 i_1 \Big|_{t=1.67\times10^{-3}} = 1.68\times10^{-5} \text{ VOLTS} \quad (40)$$

$$\beta_1 = \frac{1}{C_1}\int_{t=0}^{t=1.67\times10^{-3}} i_1\,dt = 116.5 \quad (41)$$

$$\frac{V}{s(1+e^{-ks})} + \alpha_1 - \frac{\beta_1}{s} = (L_1 s + R_1 + \frac{1}{C_1 s})I_1 - MsI_2 \quad (42)$$

$$0 = -MsI_1 + (L_2 s + R_2)I_2$$

$$I_2 = \frac{\frac{MV}{(1+e^{-ks})} + \alpha_1 Ms - M\beta_1}{[(L_2R_1 + L_1R_2)s + (\frac{L_2}{C_1} + R_1R_2) + \frac{R_2}{C_1 s}]} \quad (43)$$

$$= \frac{MV + \alpha_1 Ms(1+e^{-ks}) - M\beta_1(1+e^{-ks})}{(1+e^{-ks})[(L_2R_1+L_1R_2)s + (\frac{L_2}{C_1} + R_1R_2) + \frac{R_2}{C_1 s}]} \quad (44)$$

FIG. 7i $$I_2 = \frac{7.92 + 1.11 \times 10^{-5}(1+e^{-10^{-5}s})s - 76.96(1+e^{-10^{-5}s})}{(1+e^{-10^{-5}s})\left[1.446 \times 10^2 s + 3.25 \times 10^7 + \frac{4 \times 10^9}{s}\right]} \quad (45)$$

$$i_2 = -0.544 e^{-2.2464 \times 10^5 t} + 27.66 \times 10^{-5} e^{-1.23 \times 10^2 t} \quad (46)$$

$$v_2 = -L_2 \frac{di_2}{dt} \quad (47)$$

$$= [(-65)(-.544)(-2.2464 \times 10^5)]e^{-2.2464 \times 10^5 t} + [(-65)(27.66 \times 10^{-5})(-1.23 \times 10^2)]e^{-1.23 \times 10^2 t} \quad (48)$$

$$= -7.94 \times 10^6 e^{-2.2464 \times 10^5 t} + 2.21 e^{-1.23 \times 10^2 t} \quad (49)$$

$$\mathcal{E} = \int_{t=0}^{t=.278 \times 10^{-3}} v_2 i_2 \, dt \quad (50)$$

FIG. 7j $$\mathcal{E} = \int_0^{.278 \times 10^{-3}} \left[-7.94 \times 10^6 e^{-2.2464 \times 10^5 t} + 2.21 e^{-1.23 \times 10^2 t}\right] \times \left[-.544 e^{-2.464 \times 10^5 t} + 27.66 \times 10^{-5} e^{-1.23 \times 10^2 t}\right] \quad (51)$$

$$= 9.6 \text{ WATT-SECONDS} \quad (52)$$

$$\frac{\text{Expression (52)}}{\text{Expression (25)}} = \frac{\text{Inventive System Energy}}{\text{Kettering System Energy}} = 1875 \quad (53)$$

FIG. 7k

PARAMETERS, VALUE AND USE

| SYMBOL & PARAMETER | MEASURED VALUE | USE |
|---|---|---|
| $L_1$ | $6.7 \times 10^{-3}$ henries | self inductance of 81 |
| $L_2$ | 65 henries | self inductance of 82 |
| M | 0.66 henries | mutual inductance of 80 |
| $R_1$ | 1.4 ohms | series resistance of $L_1$ |
| $R_2$ | 8,000 ohms | series resistance of $L_2$ |
| $C_1$ | 2 microfarads | capacitor in series with 81 |
| $C_0$ | 0.1 microfarads | capacitor in circuit (1) |

FIG. 7l

SYMBOLS AND DEFINITIONS

| SYMBOL | DEFINITION |
|---|---|
| $k$ | $10^{-5}$ SECONDS, HALF PERIOD OF SQUARE WAVE OF 60 |
| $t$ | VARIABLE IN THE TIME DOMAIN |
| $s$ | VARIABLE IN THE COMPLEX DOMAIN (COMPLEX OPERATOR) |
| $I$ | CURRENT AS A FUNCTION IN THE COMPLEX DOMAIN, MAY BE SOLVED BY THE DIRECT LAPLACE TRANSFORM $\mathcal{L}f(t) = \int_{t=0}^{t=\infty} f(t)e^{-st}dt$ |
| $i$ | CURRENT AS A FUNCTION IN THE TIME DOMAIN, MAY BE SOLVED BY THE INVERSE LAPLACE TRANSFORM $\mathcal{L}^{-1}f(s) = \frac{1}{2\pi j}\int_{s=-j\infty}^{s=+j\infty} f(s)e^{ts}ds = \sum$ RESIDUES AT POLES |
| $f(t)$ | FUNCTION OF TIME |
| $f(s)$ | FUNCTION OF THE COMPLEX DOMAIN |
| $V$ | 12 VOLTS, DC OR PEAK OF SQUARE WAVE |
| $\mathcal{E}$ | ENERGY |

FIG. 7m

NON-DC IGNITION SYSTEM WITH VARIABLE IGNITION TIMING

BACKGROUND OF THE INVENTION

This invention is in the field of electronic ignition systems and particularly in the field of such systems that electronically enable variable firing periods for the igniters with non-DC power energizing such igniters.

No system is know which provides both alternating current to the igniters and at the same time electronically provides variable firing periods, which are inversely proportional to the engine speed, to such igniters.

SUMMARY OF THE INVENTION

An ignition system providing variable ignition timing periods to an engine during operative mode of the system, comprises the combination of an angularly modulated waveform generator, an electronic control circuit electrically coupled to the generator, said control circuit being intermittently biased by the generator during said operative mode, and a power source which provides output power whose amplitude varies as a function of time, said power source being electrically connected to the control circuit.

The control circuit output may be electrically connected so as to intermittently control DC input power to the power source. The output of such control circuit may also be connected across the ignition transformer primary, across an impedance matching capacitor in series with the ignition transformer primary, or across the output of the power source per se.

The waveform generator includes a variable capacitor as an integral part thereof, such capacitor being driven by the distributor drive shaft which is driven by the engine during said operative mode.

The control circuit may include an integrator electrically connected to and fed by the generator.

Means may be electrically interconnected between the generator and the control circuit for converting intermittently angularly modulated wave trains from the generator output into bias gate signal periods, such bias gate signal periods being substantially inversely proportional to the rotational speed of the engine.

Thus the generator may provide intermittently generated wave trains during such operative mode, each of the wave trains having a duration period substantially inversely proportional to the rotational speed of the engine.

The integrator used may include a diode in series therewith to discriminate against bipolar output waveforms from the generator output where such generator provides such output, passing only wave trains therefrom of predetermined polarity. Each of the wave trains provides a plural number of repetition cycles to the control circuit thereby cycling direct current power input to the power source a like plural number of times. Each of the wave trains may also provide a plural number of repetition cycles of varying time durations to the control circuit thereby cycling direct current power input to the power source a like plural number of times of like varying time durations.

Such wave train characteristics may also be used to cycle firing power output from the power source a plural number of times and a plural number of time durations when the control circuit output is connected across the power source output or across the ignition transformer input.

Figure 1:
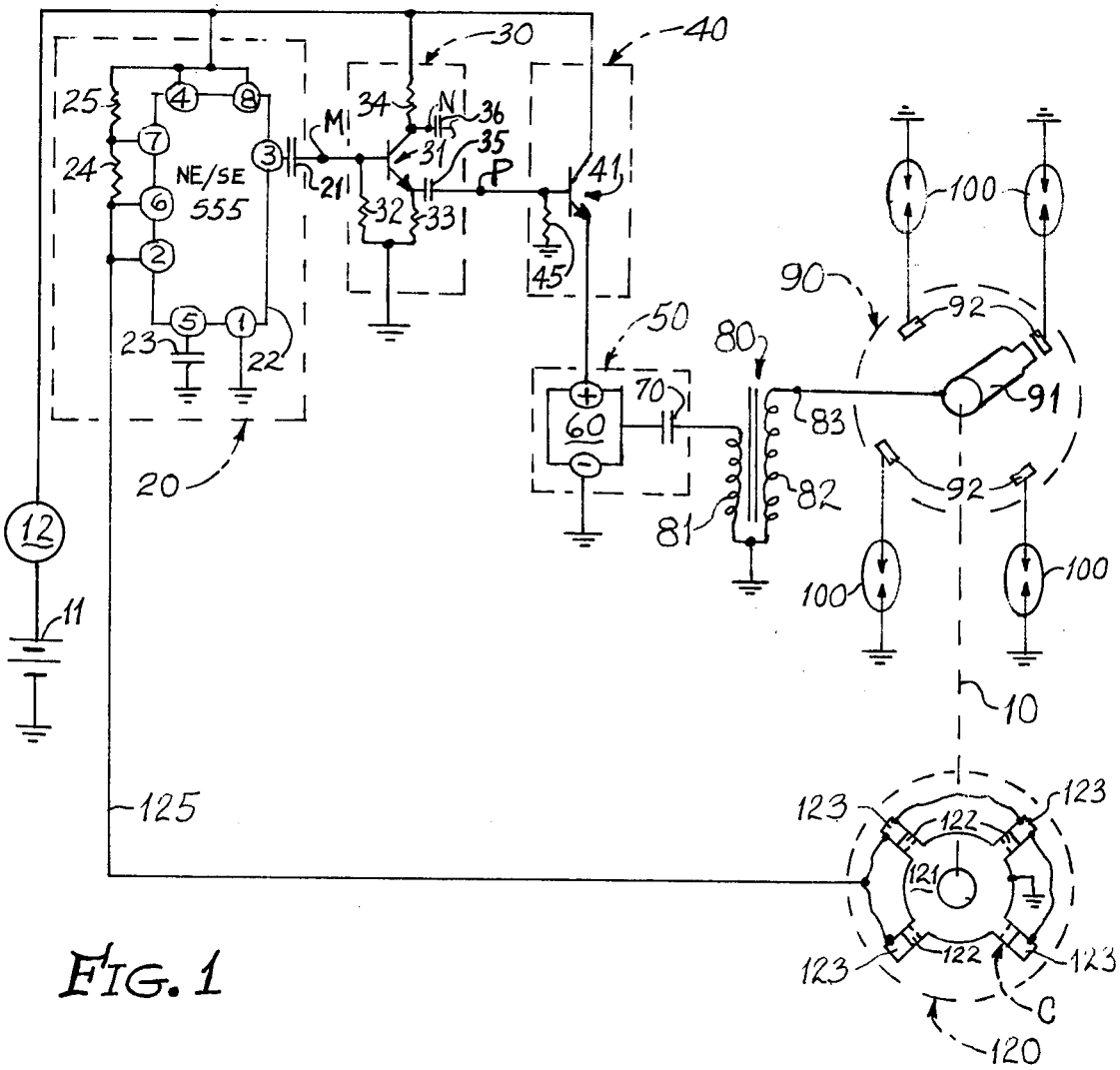
FIG. 1 is a system electronic schematic showing variable time period control of the invention.

FIGS. *7a–7m* constitute tables of definitions and equations utilized to show theoretical energy levels obtainable by a conventional Kettering ignition system and the system herein according to the invention.

DETAILED DESCRIPTION

Referring to FIGS. 1, 1*a*, 1*b*, 1*c*, 2 and 3, an ignition system providing ignition timing periods to an engine during operative mode of the system utilizes an angularly modulated waveform generator as the basic unit that enables generation of varying timing periods as hereinbelow discussed:

Throughout the discussion it will be understood that the conventional ground symbols are used herein as both the negative battery or DC potential as well as the signal return paths.

Hence battery 11 provides DC power through ignition switch 12 to waveform generator 20, to amplifier 30, and to electronic switch 40.

Waveform generator 20 may comprise of type NE/SE 555 integrated circuit 22 connected in astable manner. With the aid of capacitor 23 connected to terminal 5 thereof and resistor 24 connected between terminals 6 and 7 with resistor 25 connected between terminals 7 and 4, terminal 1 being grounded and terminals 4 and 8 being connected to switch 12. Output voltage levels are provided between terminals 3 and ground at M.

Alternately waveform generator 20 may comprise a conventional sinusoidal or other waveshape oscillatory circuit which has a capacitor such as C as part of the tank circuit thereof.

Integrated circuit 22 is made by a number of manufacturers, the most prominent being Signetics Corporation of 811 East Arques Avenue, Sunnyvale, California 94086, at pages 158–161 in the Analog Section of their Data Manual, Copyright 1976, such circuit is also shown in their publication entitled Digital Linear MOS Applications, copyright 1974, at pages 6–78 to 6–90 in greater detail. Said manuals provide the circuit information necessary to connect the NE/SE 555 timer unit 22 as an astable or free running multivibrator providing rectangular wave outputs therefrom at terminal 3, which may be summarized briefly in the following table:

| Astable Connection<br>Resistor 24 = 5,000 ohms<br>Resistor 25 = 10,000 ohms<br>Capacitor 23 = 0.01 microfarads | |
|---|---|
| Nominal Repetative Rate Output | Nominal Value of C (Capacitor 120) |
| 50 kilohertz | 1440 pF |
| 100 kilohertz | 720 pF |
| 1 megahertz | 72 pF |

where C is the value of capacitance obtained when protrusions 122 extending from wheel 121 of driven capacitor 120 are aligned with stationary members 123 of such capacitor 120.

Wheel 121 is driven by distributor shaft 10 of an engine which is the same shaft driving distributor rotor 91 of distributor 90. Shown herein are stationary members 123 electrically connected in parallel to obtain maximum capacitance from capacitor 120. Members 123 are also interconnected by means of cable 125 to terminals 2 and 6 of timer unit 22. Hence capacitor 120, its effective capacitance denoted by letter C, is the capacitance needed to be connected to timer 22 to obtain the various capacitances shown in the table above so that the waveform generator 20 will provide the repetitive rates indicated at output 3.

Should the capacitive values be too small by interconnecting members 123, then a short length of coaxial cable, much as RG 58U, can be used instead of cable 125 connecting the shield thereof to ground thereby effectively adding the capacitance of the coaxial cable in parallel with the capacitance of 120. On the other hand, should the capacitance of 120 be too large, then only one, two or three of stationary members 123 may be interconnected.

It is of course understood that wheel 121 is shown with four protrusions since the system illustrated is for a four cylinder engine. Should a six cylinder engine be controlled by this system, then wheel 121 will have six protrusions, and if an eight cylinder engine is being controlled then wheel 121 will have eight protrusions, one per cylinder. Of course the distributor will have a like member of stationary members 92 as there are protrusions 122 on wheel 121, wherein each of stationary members 92 will be connected respectively to one igniter 100.

Further, it should be noted that although as shown, protrusions 122 of wheel 121 overlap but do not cooperate with stationary members 123, that capacitance C can be further controlled by moving wheel 121 higher or lower on drive shaft 10 to respectively decrease or increase capacitance C. Likewise wheel 121 does not have to have flat protrusions 122 overlapping flat stationary members 123. Such wheel 121 can be designed similar to the reluctor wheel of a magnetic pulse timer, wherein the wheel has ridges running lengthwise parallel to its rotational axis, with a stationary member opposite it so that spacing between the stationary member and the ridges would be in a direction perpendicular to the spacing resulting in capacitance C, and in the latter case, the stationary members may be positioned radially toward or away from shaft 10 to obtain the designed capacitance.

Accordingly wherein shaft 10 drives wheel 121 and the leading edge of protrusions 122 are at the leading edges of stationary members 123, waveform generator will begin to oscillate at the highest possible repetition rate considering the parameters selected per above table. When protrusions 122 are in line with stationary members 123, the oscillating repetiton rate will be the lowest possible with the same selected parameters. As shaft 10 drives wheel 121 so that the lagging edges of protrusions 122 are at the lagging edges of stationary members 123 again the lowest possible oscillating repetition rate will be provided by generator 20 at M. Thus any period wherein such protrusions are driven past the stationary members, the MARK condition will obtain, and during periods in between the MARK condition, when generator has substantially zero capacitance provided by capacitor 120, the SPACE condition or non-oscillating condition of generator 20 will prevail.

Thus in our case, we have illustrated a four cylinder ignition system and have arbitrarily chosen the width dimensions of protrusions 122 and stationary members 123 so that the MARK period will be present during 30° of shaft rotation and the SPACE period during 60° of shaft rotation.

It may be possible however with a system, as here, that can provide continuous non DC energy power to the ignition transformer, that either greater or lesser timing control during the MARK period is needed when the igniters are firing. To decrease the MARK period and thereby increase the SPACE period, protrusions 122 and members 123 will be made less wide, and conversely to increase the MARK period and thereby decrease the SPACE period, protrusions 122 and members 123 are made more wide. In fact, practically speaking, it will only be necessary to change the width of either the stationary members 123 or the protrusions 122 to obtain changes in the MARK to SPACE ratios. It is therefore obvious that such MARK periods may be changed readily by changing wheels 121, or one or more stationary members 123.

Without any integrator circuits at the outputs of waveform generator 20, driving wheel 121 will produce changes in capacitance C thereby during MARK periods, producing first a high frequency of repetition which decreases in its rate to its lowest rate at the center of the MARK period or wave train and then increases again in repetition frequency at the end of the MARK period. Thus the MARK period demonstrates a waveform that has characteristics of angular modulation, that is frequency and/or phase modulation characteristics.

Accordingly when such MARK waveform at M is fed through amplifier 30 it will trigger such amplifier ON and OFF in accordance with the particular repetition rate of circuit 22 and also trigger the amplifier ON and OFF for the duration period of the pulse width present in the MARK period. Conceivably, with a normal frequency of 100 kilohertz, it may be possible to trigger amplifier 30 ON and OFF 30 thousand times per second and as little as ten thousand times per second for duration periods ranging between $3\times10^{-5}$ to $10^{-4}$ seconds dependant upon the frequency of oscillation designed by selection of parameters as in the above table.

An important feature is the inability of the integrated circuit 22 to be made to oscillate at any frequency substantially greater than one megahertz. This provides the assurance that stray capacitances in component 120 will be insufficient to create spurrious oscillations, and therefore assure a zero output therefrom during the SPACE periods.

Amplifier 30 is basically not essential when generator 20 provides sufficient voltage output from terminal 3 to trigger the base of transistor 41 at a positive potential with respect to ground, to cause condition between collector and emitter of transistor 41, so that DC power from the emitter will be available at the + terminal of non-DC power source 60 to energize source 60 during the MARK period.

Coupling capacitor 21 of about 0.1 microfarads should be used between terminal 3 and the next succeeding stage to prevent DC used to feed the components of 22 from biasing the base of such next succeeding stage.

Amplifier 30 is provided with bias resistor 32 that places a negative bias at its base to prevent conduction. During the MARK period, a positive going group of pulses are provided at M or the base of transistor 31 to overcome the negative bias thereat, raising the base potential positive, to start DC current to flow through resistor 34, the collector, through the emitter and through resistor 33 to ground. During conduction of amplifier 30, a positive going series of pulses as at P will provide the positive potential at the base of transistor 41, through coupling capacitor 33, to turn same on. Conventionally a negative going train of pulses at N, opposite in polarity to the pulses at P, will be provided at the collector of transistor 31. Such negative pulse trains will not be used in this configuration, and will be referred to in connection with later discussed configurations. It should be noted that resistor 45 has the function of providing negative bias to the base of transistor 41 and holding switch 40 non-conductive during quiescent or SPACE periods. But when the pulse trains at M trigger amplifier 30 to start its conduction state, the amplified positive-going pulse train at P, during the MARK phase will provide the angular modulation phenomena referred to above, to turn switch 40 ON and OFF following the excursions of the repetition rates at M and their duration periods during such MARK periods, thus turning ON and OFF the DC power to the non-DC power source 60, in like manner.

The non-DC power source, generally having between 2 and 10 kilohertz repetition rate, will, during the MARK periods feed capacitor 70, which capacitor is necessary to match output impedance of source 60 during MARK periods or igniter firing periods to the input impedance presented at primary 81 of ignition transformer 80 for rapid transfer of energy to secondary 82 and hence to rotor 91 via wire 83 during such MARK periods only, since during SPACE periods no energy will be transferred, and rotor 91 will not be aligned with any of stator elements 92.

Accordingly, capacitor 70 may be connected as an intergel part of non-DC power source 50, since the power generator 60 requires capacitor 70 as an impedance matching device, as well to prevent any DC components from feeding ignition transformer primary 81, inapposite to conventional methods.

Whereas it may be desireable to change or interrupt the power being fed to ignition transformer 80 a plural number of times by virtue the frequency pulse period changes occurring during the MARK periods, it may also be desireable to inhibit such excursions and time durations of interruptions in power during such MARK periods.

Figure 1A:
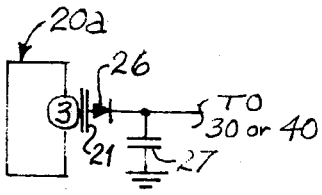
FIG. 1*a* is a partial schematic of an integrator and polarization discriminator as may be used within the circuit of FIG. 1.
Figure 1B:
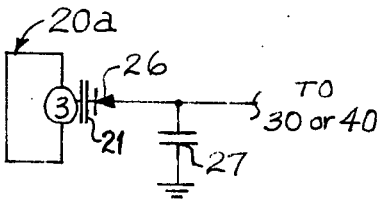
FIG. 1*b* is a partial schematic of an integrator and another polarization discriminator as may be used within the circuit of FIG. 1.
Figure 1C:
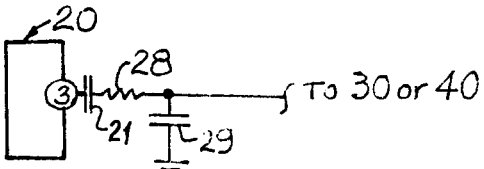
FIG. 1*c* is a partial schematic of an integrator as may be used within the circuit of FIG. 1 to provide bias gate periods of varying time durations.

To accomplish this, an integrator circuit such as shown in FIGS. 1*a*, 1*b* or 1*c*, may be interposed between capacitor 21 and the base of transistor 31. Assuming a nominal repetition rate of 100 kilohertz, the average time period for each pulse excursion thereof will be $10^{-5}$ seconds. Accordingly a positive bias gate can be established during the MARK period by preventing these excursions and holding the voltage levels of the MARK signals at substantially their peak values. The time constant of capacitor 29 and resistor 32 will therefore have to be between 5 and 10 times the time constant of resistor 28 and capacitor 29 in order not to drain the charge upon capacitor 29 before the end of the MARK period. Thus bias resistor 32 will turn out to be between 5 and 10 times the value of resistor 28. Integrators consisting of diode 26 and capacitor 27 may be used when extremely short time constants are involved, and of course where circuit 20*a* provides a bipolar output.

Circuit 30 will have coupling capacitors 35 and 36 of about 0.1 microfarads connected respectively to the emitter and collector thereof to prevent DC supplied to transistor 31 from being applied to the base of transistor 41. In the case of capacitor 36 such will be employed in later discussed configurations. Where no circuit 30 is needed, then capacitor 21 is connected to the base of transistor 41 feeding waveform M directly to the base of transistor 41.

For the assumed $10^{-5}$ seconds nominal period, the time constant for resistor 28 and capacitor 29 would be $10^{31\ 5}$ seconds, and other time constants of the parameters involving capacitor 29 and bias resistors of the next succeeding transistor stage will have to be 5 to 10 times as great to prevent rapid discharge of the peak values of voltage attained. From this criteria, the values of the integrator circuit components can be determined. The assumed time constant should be based upon the lowest repetiton rate exhibited in the varying pulse widths within any one MARK period.

Of course, a diode connected as at 26 in FIGS. 1*a* or 1*b* can be used in series with member 28 of the integrator circuit of FIG. 1*c* when the multivibrator at 22 has a bipolar output, and only one predetermined polarity is required to feed either circuits 30 or 40. The addition of diode 26 will not change the input resistance to any degree of the integrator circuits.

Thus it can be seen, that either a multi pulse width gate can be established at M during the MARK period which varies in repetition periods and time duration periods during any one MARK cycle, or a gate having a constant output potential at M during such MARK period by use of the integrator, to provide bias to the control circuit being fed thereby.

The firing angle of the igniters though being constant for any one wheel 121 design, will provide varying MARK time periods as the momentary location of pistons in the engine demand. Such MARK time periods are variable and are inversely proportional to the engine speed, which means the speed of rotation of distributor shaft 10 driven thereby, since at higher engine speeds the energy has to be delivered more rapidly to the igniters than at lower speeds over the same firing angle, the MARK time periods are keyed in analog computer fashion to the engine speed enabling the delivery of non-DC energy by source 50 over the required firing periods, to igniters 100.

A point of interest is that if rapid excursions of the wave trains intra any one MARK period as at M is desired, without the use of amplifier 30, or capacitor 21 being coupled to the base of transistor 41, then a fast switching transistor at 41 such as type 2N5038 should be used. On the other hand if still without the use of amplifier 30 and without the use of an integrator circuit between circuit 20 and 40 is desired under conditions where only a constant voltage bias gate at M is desired during the MARK period, then a relatively slow switching power transistor such as 2N6259 may be used which at high collector or emitter currents feeding power source 60, will not be able to follow the excursions of the waveforms provided at the output of circuit 20 and hence will provide a constant bias during the MARK period to the next succeeding transistor circuit input.

Figure 1D:
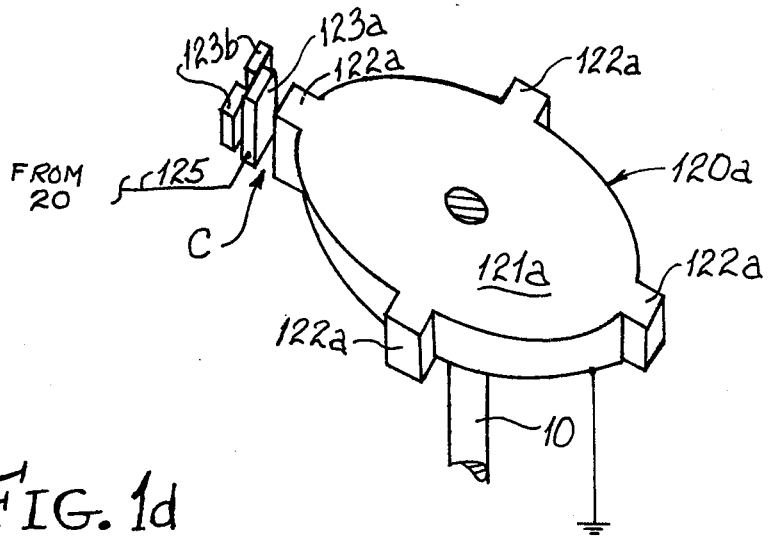
FIG. 1*d* shows an alternate structure for the variable capacitor used in FIG. 1.

Referring to FIG. 1*d*, variable capacitor 120*a* may be substituted for capacitor 120 of FIG. 1. Capacitor 120*a* is similarly driven by shaft 10 which is at ground potential. Hence wheel 121*a* with its protrusions 122*a* is driven by the shaft past stator plate 123*a*. Stator plate 123*a* has adapted thereto and is in electrical cooperation with plates 123*b* which may be moved in circumferential or wheel 121*a* rotational direction so that the effective area of the capacitor C plates formed by 123*a* and 123*b* as one plate and protrusions 122*a* as the other plate provides an increase in capacitance C.

Therefore, if it is desired to increase the MARK period, plates 123*b* may be moved to exhibit the greatest area in conjunction with plate 123*a* so that protrusions 122*a* will take a longer period of time to be driven past the combination of plates 123*a*–123*b*. In a four cylinder engine, it has been shown above how the capacitor in FIG. 1 provides a 30° MARK period. If moving plate 123*b* to provide the greatest area will double the radial sweep of protrusion 122*a* past 123*a*–123*b* combination, then the MARK period will be further increased from the 30° obtained in FIG. 1 circuit to 60°. Since the sum of MARK and SPACE periods in the four cylinder system cannot exceed 90°, the doubling of the MARK period to 60° will reduce the SPACE period to 30° nominally. It is obvious that the MARK period can be increased to virtually 90° with a resultant virtual zero SPACE period, or that by making the capacitor elements smaller, to decrease such MARK period and increase the SPACE period, as needed.

Figure 4:
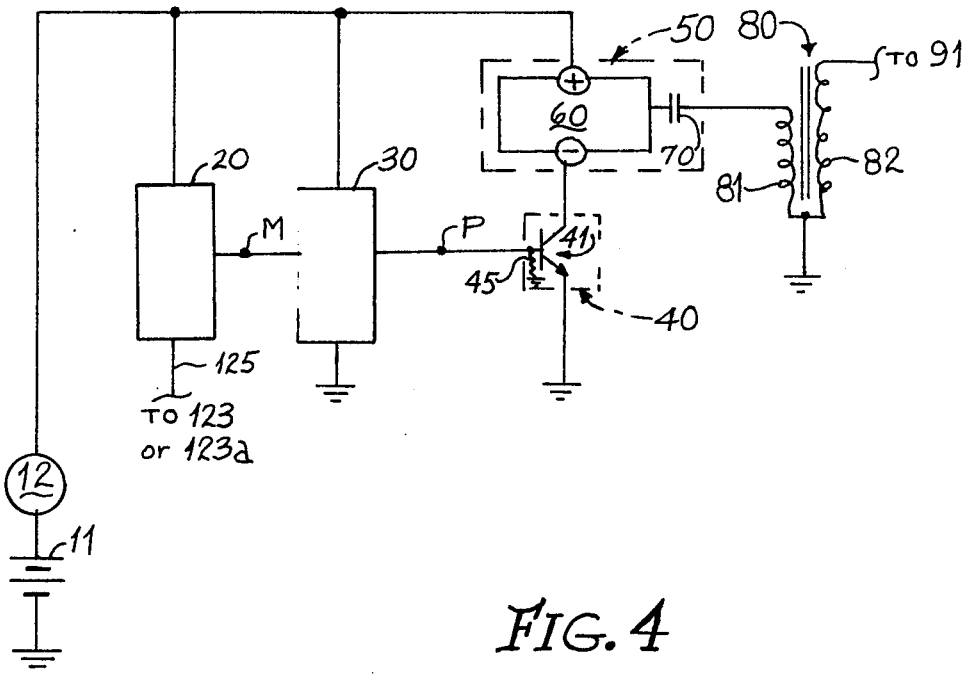
FIG. 4 is a system schematic similar in principle to that of FIG. 1 wherein DC power to the power source is controlled and timed at the negative DC power input node of the power source.

Referring to FIG. 4, the difference between it and FIG. 1 resides only in connecting switch 40 in series with the negative terminal of power source 60 to provide the identical switching action of power source 60 as described in conjunction with FIG. 1.

Figure 2:
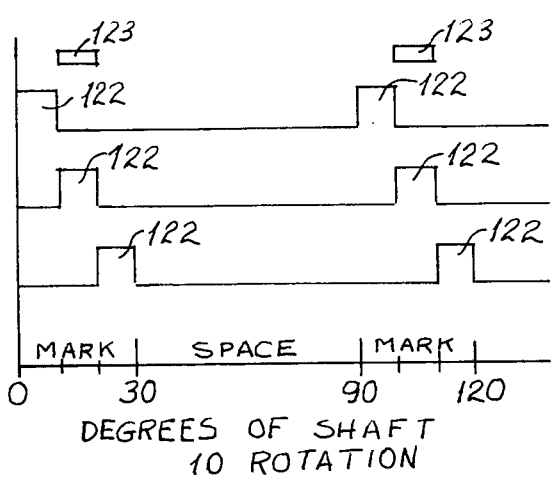
FIG. 2 shows the relative position of the rotatable elements of a capacitor driven by the distributor shaft of FIG. 1 with respect to its stationary elements for providing the bias gate periods denoted therein by mark and space periods.
Figure 3:
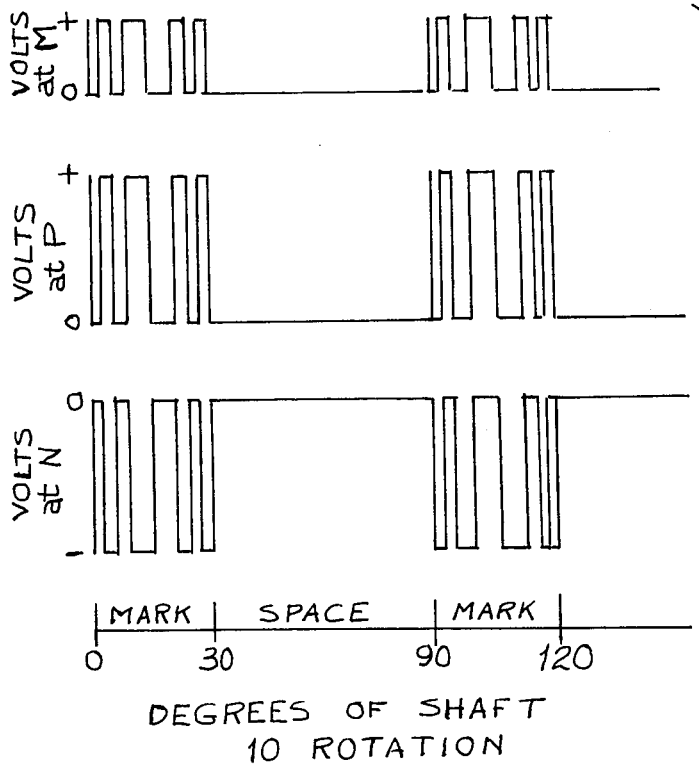
FIG. 3 shows the several voltage levels and excursions occurring in different parts of the system of FIG. 1 during the mark and space periods produced by the timing subsystem.
Figure 5:
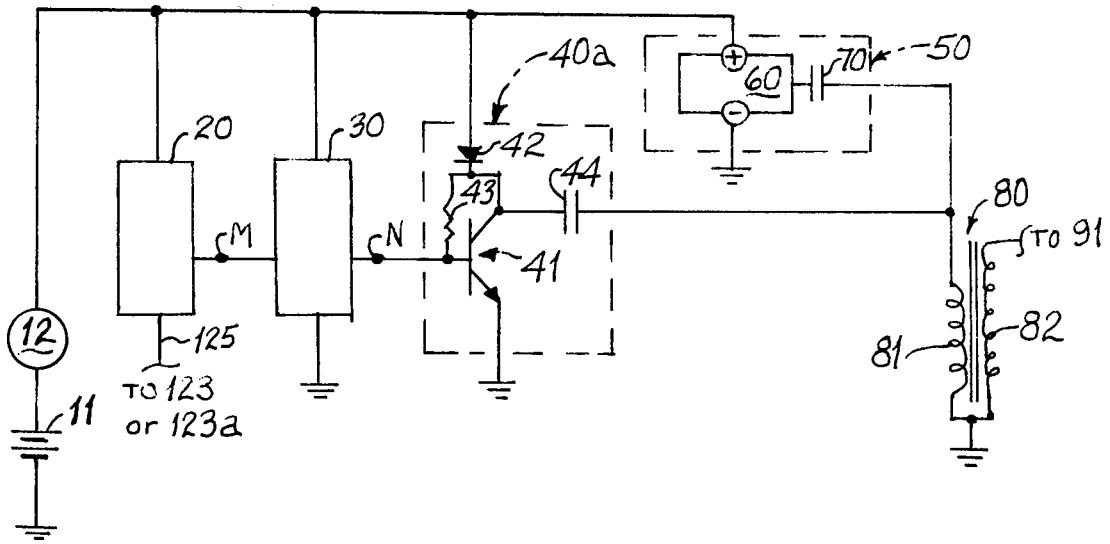
FIG. 5 is a system schematic similar in principle to that of FIG. 1 where timing of power from the power source is controlled at the ignition transformer input.

Referring to FIG. 5, the system thereof distinguishes over the system of FIGS. 1 or 2 in that power source 60 is constantly powered with DC current, and instead of switching DC power to source 60, electronic switch 40*a* is normally in the conductive state during the SPACE periods, the base thereof being positively biased by resistor 43 receiving its positive potential from battery 11 through diode 42, so that current will flow between the collector and emitter of transistor 41 during such SPACE period.

Capacitor 44 is connected between the collector and the ungrounded side of primary winding 81 of ignition transformer 80, maintaining a virtual AC short circuit across primary 81 during the SPACE period.

When a negative wave train is provided at N as an output of circuit 30, detailed in FIG. 1, the positive bias voltage on the base of transistor 41 is overcome by the higher level negative voltage excursion of the waveform at N to cause transistor 41 to stop conducting. Since such negative waveform at N is present during the MARK period only, shown in FIG. 3, current will be permitted to flow from power source 60 through capacitor 70 and into primary winding 81. Such current flow is possible due to stoppage of conduction of transistor 41 exhibiting a high impedance during the MARK period. Capacitor 44 is used herein since during the SPACE period current flowing between collector and emitter would also be directed through primary 81, and as stated above, it is desired to only pass a non-DC current through such primary. The timing sequences and behavior discussed in connection with FIGS. 1, 1*a*, 1*b*, 1*c*, 2 and 3 are otherwise identically applicable to FIG. 5.

Figure 6:
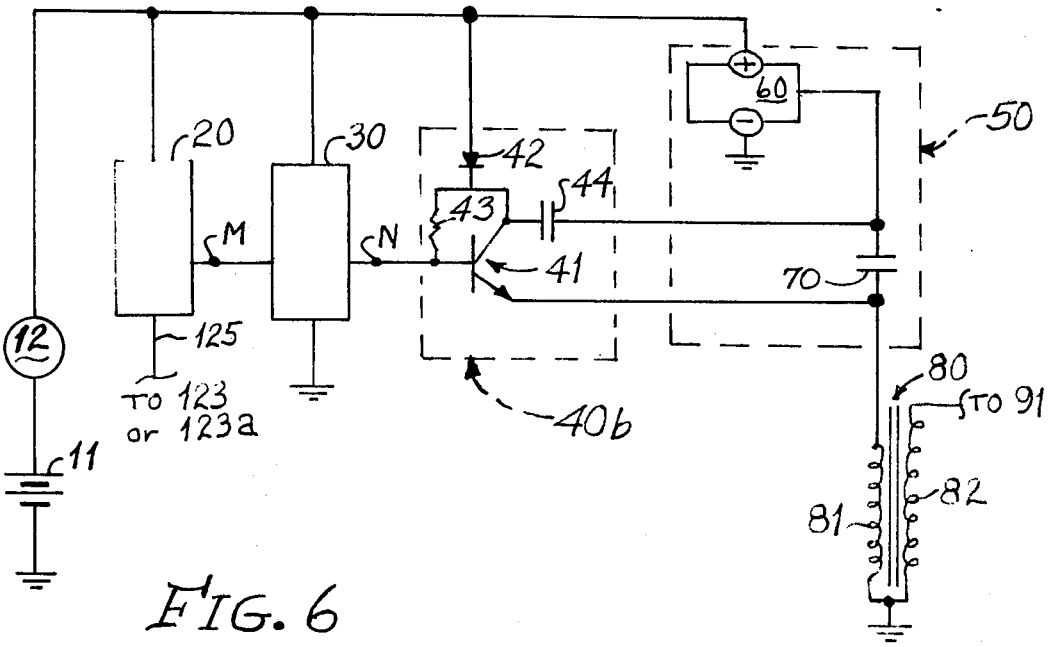
FIG. 6 is a system schematic similar in principle to that of FIG. 1 where timing of power from the power source is controlled at the impedance matching capacitor output of the power source.
Figures 7A, 7B:
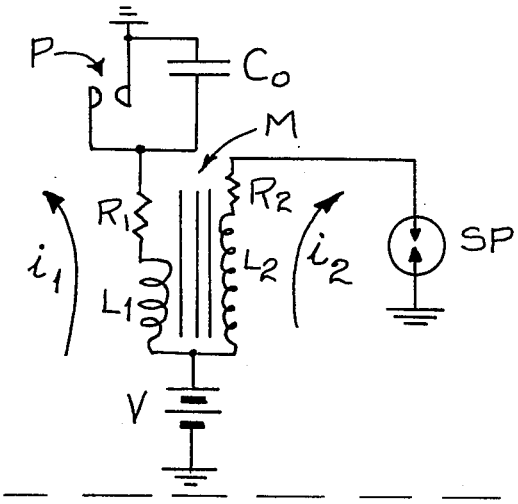
Figures 7E, 7F:
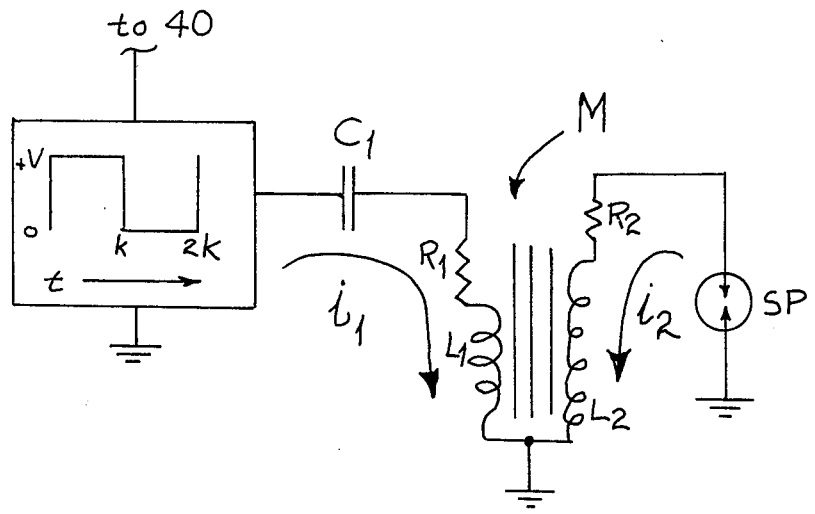

Referring to FIG. 6, the operation thereof is identical to that of FIG. 5 except that instead of short circuiting the primary winding of transfuser 80, capacitor 70 is short circuited during the SPACE periods by connecting collector and emitter thereacross. Since capacitor 70 is an impedance matching device, it can be appreciated that short circuiting this capacitor will provide a large mismatch of impedance and not permit sufficient power to energize transformer 80 during the SPACE periods thereby inhibiting firing of igniters during such periods. As in the case of FIG. 5, wherein switch 40*a* is connected to cease conduction by application of negatively polarized wave trains at N, the impedance at 40*b* between collector and emitter will become high and the mismatch removed to permit a high current to flow through capacitor 70 from power source 60 and through primary 81 during the MARK periods in same manner and principle as discussed in connection with FIGS. 1, 1*a*, 1*b*, 1*c*, 2 and 3 above.

Referring to all figures, the importance of impedance matching ignition transformer input to the impedance of the non-DC power source output during igniter firing for obtaining maximum power transfer and hence high energy delivery to the igniters, as well as keeping DC components from flowing in the ignition transformer primary or secondary windings, cannot be overemphasized.

If source 60 comprises a multivibrator circuit, without an output transformer for coupling same to the ignition transformer, then capacitor 70 is needed, firstly to block any DC components from flowing into primary winding 81, and secondly to match the output impedance which is generally low to the impedance seen by looking into transformer 81 primary.

If source 60 comprises a multivibrator or other oscillatory power circuit, using an output transformer for coupling to the ignition transformer, then capacitor 70 is still needed to match the output impedance of the output transformer to the input impedance of transformer 80 under igniter firing condition.

Capacitor 70 provides a capacitive reactance which helps to cancel some of the high inductive reactance presented at the ignition transformer input under igniter firing condition since the inductive reactance of the ignition transformer secondary is reflected back into the transformer primary inversely as the turns ratio. Still considering an inductance of about 65 henries of the secondary, the effective inductive reactance component reflected into the primary is sufficiently high to offer a high impedance in the collector-emitter circuit of any transistors used as means for obtaining oscillation, with the result of drastically limiting the AC current flow in such collector-emitter circuits, and such transistor source delivering a trivial amount of power to the ignition transformer.

This fact makes it possible to use the circuit of FIG. 6 which reduces the current flow in primary 81 to an insignificant value when transistor 41 is conducting by virtue of merely providing an AC short circuit across capacitor 70 during the SPACE mode, which is the same as if capacitor 70 were not in the circuit and the output of the non-DC source 60 were connected directly to the high side of primary 81. Such results have been experimentally verified, and serve to show an advantage of controlling the MARK and SPACE periods by merely short circuiting capacitor 70 during the SPACE periods with transistor switch 41. Using an output transformer in the oscillatory source with a so-called "high voltage" output winding to directly feed the ignition distributor, would also result in a very high impedance presented to the power transistors of the oscillatory circuit in view of the high voltage winding possessing a very high inductance and result in low power delivery, if at all.

The conclusions are obvious, in that the above facts confirm that impedance match and hence maximum power transfer has not been considered by prior art utilizing transistor or tube oscillator power sources, such power sources will fail to provide sufficient power to the ignition transformer to result in any significant advantages, and instead provide power of levels approximating the Kettering system power levels, and not of the type of power level which is 1875 times the Kettering level, as shown in the computations which are herein incorporated by reference.

The other important aspect to be appreciated is that once having power delivery capability as above discussed, the harnessing and exact control of such power is achieved by an inexpensive analog type device that is capable of controlling the power in varying time periods as the engine demands in a number of different ways above discussed.

It may be noted that whereas it is not practical to provide impedance matching by using a value of capacitance in parallel with the ignition transformer primary or secondary, which value of capacitance would be different than the series capacitor 70, such may be theoretically possible with appropriate ignition transformer characteristics.

Referring to FIGS. *7a–7m*, the mathematical relationships will be established in terms of equivalent circuit at 1 for the conventional Kettering system, and the equivalent circuit at 26 for the inventive system to determine the energy levels deliverd by these circuits to an igniter. It will be understood that circuit 26 represents the equivalent circuit for current and voltage computations of the system as shown in FIGS. 1, 4, 5 or 6, although switching AC power or other switching action to set up the transient conditions are effected in different ways in different parts of the system, as explained hereinabove.

The mathematical expressions will be based upon the values of the various components used and the definitions of parameters and transforms as given in the tables.

The Kettering system analysis is being provided, as this type of ignition system has been the standard of the automotive industry for more than a half-century, and is a good baseline by which to compare the increased energy delivered by the inventive system.

Accordingly, referring to the equivalent circuit 1, the loop currents $i_1$ and $i_2$ in the primary and secondary circuits respectively may be written symbolically in differential equation form at 2. Equation pair 2 is transformed by Laplace transformation from the time domain to the complex domain as shown at 3. Such transformation enables easy solution by algebraic methods of the variables, namely the current terms.

Equations 4 shows the solution in Laplace transform notation for the primary circuit current. However, for the parameter values in the tables, it can be seen that since $L_1L_2 - M^2$ as shown in 5, the expression in Laplace can be simplified in steps to obtain expressions 6 and 7.

The form of 7 is readily transformed by inverse Laplace transformation to the time domain, or such solution may be obtained from Laplace transform pairs if desired. Before making the inverse transformation to the time domain, it is necessary to substitute the value of parameters in 6 to obtain 7 in numerical terms. Accordingly, it can be seen that the primary current $i_1$ without initial conditions is shown at 8 as a function of time.

Solution in form of 8 is necessary in order to use the complete current expression (the transient term and the steady state term) so that initial conditions can be accurately determined.

The initial voltage in the primary winding is determined by evaluating expression 8 at time $t = 1.67$ milliseconds, which is the computed time available to charge the primary for any one igniter firing for the 8 cylinder engine driven at 6000 rpm, selected for use in all these computations. The substitution of numerical values and evaluation thereof results in expressions 9 and 10, the latter giving the initial voltage which is added to the voltage applied by the battery to form the equations that follow so as to obtain a true expression of the relationships existing in the primary circuit.

In the Kettering case, there will be no initial charge in capacitor $C_0$ since that capacitor is shorted by points P during the charge mode of $L_1$.

The secondary current will be solved in a similar manner as above described for the primary current to obtain the initial condition in $L_2$ as shown by expressions 11, 12, 13 and 14.

Utilizing the initial conditions, equation pair 3 may now be rewritten as equation pair 15 including these initial conditions and pair 15 may be solved by Laplace methods resulting in equations 16 through 19 for the secondary current $i_2$, which is the firing current of an igniter, as a function of time.

Remembering that the firing period which had been allocated as 0.278 milliseconds for the 8 cylinder engine at 6000 rpm driving a distributor arm past a stationary member for only such brief period, the energy level expression below will have to be computed using the 0.278 millisecond period.

However, it will be necessary to first obtain the induced voltage in the secondary widing due to flow of transient current as in 19, and such may be obtained by application of Faraday's law of induction, as stated at 20, from which expressions 21 and 22 result in numerical form as a transient voltage induced in the secondary winding.

Energy computations are then made by integrating as at 23 over the 0.278 millisecond time period, the product of current and voltage as shown in expressions 19 and 22 respectively, to result in 24 and finally in the actual energy level in watt-seconds at 25.

The procedure for mathematically analyzing the inventive circuits is based on the equivalent circuit at 26, so that in a like manner as above evaluated in the case of the Kettering system, the initial conditions can be established, the current and voltage expressions derived for the secondary winding circuit with initial cnditions considered, and energy levle at igniter firing determined by integrating the product of voltage and current expressions over the same time period as in the Kettering system. However, here there will be an initial charge in capacitor $C_1$ powered by square wave generator 60, as well as initial charge in the primary and secondary windings, and such initial conditions will be included in solving for the firing current. It should also be observed that the expression in Laplace transform for the square wave will be substantially more complex than for the simple step function of the Kettering system due to the battery voltage. In order to obtain a fair comparison between the inventive system and the Kettering system, the peak value of the square wave voltage was taken at the same value as the battery voltage in the Kettering system.

Consequently, expressions 28 through 41 are used to establish the initial conditions which are used in equation pair 42 in Laplace notation.

As in the Kettering system, such equation pair 42 was solved for the secondary or firing current $i_2$ by proceeding through the steps of expressions 44 and 45 to define such firing current at 46.

The voltage induced into the secondary was solved by application of Faraday's law of induction as in 47, and solving numerically as in 48 resulted in such induced secondary voltage at 49.

The energy level is therefore the product of voltage and current integrated over the 0.278 millisecond firing period, and is shown generally at 50 and in specific values as computed at 51. The result of such integration at 52 shows an extremely large energy quantity delivered to the igniter on firing.

The magnitude of improvement of the inventive system over the conventional Kettering system can now be appreciated by takng the ratio of these energy levels as at 53, which ratio is 1875, or a 187,500% improvement over the Kettering system.

What is claimed is:

1. A method for fuel ignition in an engine by electrically energizing any of a plural number of igniters therein, comprising in combination the steps of:

(a) computing the individual firing period for each of the igniters, one igniter firing period at a time;

(b) compensating for the reactive component difference between the output of a non-DC power source and the input of an ignition transformer; and (c) energizing each of the igniters with the non-DC power provided to said transformer during each of their respectively computed firing periods.

2. The method as stated in claim 1, wherein step (a) includes the steps of:

intermittently angularly modulating a waveform generator by means integral therewith, said means being driven by the engine;

feeding the waveform generator output to an electronic switch; and activating the non-DC power source for each computed firing period.

3. The method as stated in claim 2, wherein step (b) includes the step of feeding power output from the non-DC power source substantially during each firing period to a capacitor and the ignition transformer.

4. The method as stated in claim 3, wherein step (c) includes the steps of:

distributing the power fed the transformer; and firing said igniters with the distributed power substantially for the duration of each of their respectively computed firing periods.

5. The method as stated in claim 2, including the step of integrating the output of the waveform generator to form a bias gate having a duration substantially equal to the firing period.

6. The method as stated in claim 2, wherein the intermittently angularly modulated waveform generator provides a wave train having varying repetition cycles with varying time durations during said repetition cycles.

7. The method as stated in claim 2, including the step of discriminating against bipolar wavetrain outputs from the waveform generator during step (a) and passing only wavetrains therefrom of predetermined polarity.

8. The method as stated in claim 1, wherein step (a) includes the steps of:

intermittently angularly modulating a waveform generator by means integral therewith, said means being driven by the engine;

feeding the waveform generator output to an electronic switch; and activating a non-DC power source concurrently with the steps of intermittently modulating and feeding the waveform generator output.

9. The method as stated in claim 8, wherein step (b) includes the steps of:

feeding the power output from the non-DC power source to a capacitor and an ignition transformer; and by-passing the input of the transformer with the electronic switch during any period intermediate two successive firing periods.

10. The method as stated in claim 9, wherein step (c) includes the steps of:

distributing the power fed the transformer from the non-DC power source during each said firing period; and firing said igniters with the distributed power substantially for the duration of each of their respectively computed firing periods.

11. The method as stated in claim 8, including the step of integrating the output of the waveform generator to form a bias gate having a duration substantially equal to the firing period.

12. The method as stated in claim 8, wherein the intermittently angularly modulated waveform generator provides a wave train having varying repetition cycles with varying time durations during said repetition cycles.

13. The method as stated in claim 8, including the step of discriminating against bipolar wavetrain outputs from the waveform generator during step (a) and passing only wavetrains therefrom of predetermined polarity.

14. The method as stated in claim 8, wherein step (b) includes the steps of:

feeding the power output from the non-DC power source to a capacitor and an ignition transformer; and by-passing the capacitor with the electronic switch during any period intermediate two successive firing periods.

15. The method as stated in claim 14, wherein step (c) includes the steps of:

distributing the power fed the transformer from the non-DC power source during each said firing period; and firing said igniters with the distributed power substantially for the duration of each of their respectively computed firing periods.

16. An ignition system which during its operative mode provides variable ignition timing periods to an engine, said system utilizing an ignition transformer, comprising the combination:

an angularly modulated waveform generator;

first means, integral with the waveform generator and driven by the engine during said operative mode, for providing wave trains of varying time durations, which time durations are inversely proportional to the rotational speed of the engine;

an electronic control circuit electrically coupled to the generator;

a non-DC power source electrically coupled to the transformer; and a capacitor in circuit with the power source and the transformer.

17. The system as stated in claim 16, wherein said first means is a variable capacitor.

18. The system as stated in claim 16, wherein the power source has a direct current input terminal to which the control circuit is electrically connected.

19. The system as stated in claim 16, wherein the output of the control circuit is electrically connected across the input of the transformer.

20. The system as stated in claim 16, wherein the output of the control circuit is electrically connected across the capacitor.

21. The system as stated in claim 16, wherein the control circuit includes an integrator electrically interposed between the generator and the electronic control circuit.

22. The system as stated in claim 16, including second means electrically interconnected between the generator and the control circuit for converting intermittently angularly modulated wave trains from the generator output into bias gate signal periods, said bias gate signal periods being substantially inversely proportional to the rotational speed of the engine.

23. The system as stated in claim 16, wherein each of the wave trains provides a plural number of repetition cycles to the control circuit.

24. The system as stated in claim 16, wherein each of the wave trains provides a plural number of repetition cycles of varying time durations to the control circuit.

25. The system as stated in claim 21, wherein the integrator discriminates against bipolar output wave trains from the generator, passing only wave trains of predetermined polarity.

* * * * *